United States Patent [19]

Coyman et al.

[11] Patent Number: 4,956,826

[45] Date of Patent: Sep. 11, 1990

[54] MULTI-YEAR TIME CLOCK HAVING AUTOMATIC DAYLIGHT SAVING TIME COMPENSATOR

[75] Inventors: Dennis Coyman, Sterling Forest, N.Y.; Richard Gawronski, Naugatuck, Conn.

[73] Assignee: Master Free Time, Inc., Sterling Forest, N.Y.

[21] Appl. No.: 325,678

[22] Filed: Mar. 17, 1989

[51] Int. Cl.[5] ..... G04B 19/24; G04B 9/00

[52] U.S. Cl. ..... 368/28; 368/66

[58] Field of Search ..... 368/10, 28–30, 368/64, 66, 203–204

[56] References Cited

U.S. PATENT DOCUMENTS

| | | | |
|---|---|---|---|
| 3,811,265 | 5/1974 | Later | 368/52 |
| 3,922,588 | 11/1975 | Kunzel | 368/64 |
| 4,044,545 | 8/1977 | Shimizu | 368/22 |
| 4,180,969 | 1/1986 | Naito | 368/21 |
| 4,354,260 | 10/1982 | Planzo | 368/43 |
| 4,540,292 | 9/1985 | Rubenstein et al. | 368/29 |
| 4,695,168 | 9/1987 | Meister et al. | 368/31 |

*Primary Examiner*—Vit W. Miska

*Attorney, Agent, or Firm*—Ostrolenk, Faber, Gerb & Soffen

[57] ABSTRACT

A clock circuit for driving a clock movement such as a bipolar clock contains a memory which is programmed to automatically adjust the clock movement for standard and daylight saving time adjustments. The circuit is normally powered from the AC power line but includes a battery backup and is designed to run the clock circuit uninterruptedly for its entire life without needing used initiated adjusting or actuating.

20 Claims, 4 Drawing Sheets

MULTI-YEAR TIME CLOCK HAVING AUTOMATIC DAYLIGHT SAVING TIME COMPENSATOR

BACKGROUND OF THE INVENTION

The present invention relates to a clock and more particularly to a multi-year clock which is provided with a mechanism for automatically resetting the clock at the beginning and end of each daylight saving time period.

In places such as schools, factories, commercial buildings and the like where there are a large number of clocks that must all be reset at the beginning and end of each period of daylight saving time, it is desirable to be able to dispense with the troublesome reliance on human intervention to reset such clocks at the beginning and end of each such period. The resorting in the prior art to humans for taking care of the necessary time adjustments is both expensive and unreliable. This is true regardless of how simple the resetting procedure is rendered.

This is so because the seasonal daylight saving time adjustments are carried out during the middle of the night, usually around 2 A.M., when people are less alert. Further, where numerous clocks are dispersed throughout a large building and more than one individual is responsible for effecting the clock adjustments, a clock may be inadvertently reset twice. There is also the element of inconvenience involved because clocks are typically mounted high up on a wall where they can not be easily reached.

Master/slave clock systems are known in which several slave clocks are connected to a master clock and the seasonable clock adjustments are carried out at the master clock. The slave clocks respond automatically to the adjusting of the master clock. Such clock systems still suffer from the drawbacks that human intervention and actuation is required at the master clock and that slave clocks must be interwired with a master clock.

Recently introduced clocks can be programmed at the beginning of a year to automatically reset themselves during the transitions between standard and daylight saving time. These clocks respond to information which the user enters through a keyboard, dial or the like. However, even with these more sophisticated clocks, the clock user's intervention is still necessary, at least on a yearly basis. The long felt need for a stand-alone, master-less clock which will run uninterruptedly for years, even decades, and automatically adjust itself for daylight saving time, has not, to date, been satisfied by the prior art. Nor has the prior art satisfied the need for a master-less clock which is factory preprogrammed and simpler on account of the fact that it is not complicated by user controllable data entry devices such as keyboards, dials or the like.

The inventors herein are presently aware of certain patents relating to the subject matter of clocks/calendars, as follows. U.S. Pat. No. 3,277,645 to Hanson discloses a system for setting and maintaining a master clock 11 which is part of a master-slave clock system. Hanson's master clock has a so-called secondary drive mechanism, comprising a clock spring or a secondary synchronous motor which can be powered from a backup battery. The secondary drive mechanism serves to drive the movement of the master clock at its regular velocity even in the event of a power failure. Means are provided for advancing the clock one hour to set it from daylight saving time to standard time. Hanson's clock requires manual actuation for initiating daylight adjustments and does not have a memory.

U.S. Pat. No. 3,811,265 to Cater discloses a conventional, AC driven, clock 11 having an AC power source interruption detector 17. The AC interruption detector 17 serves to energize circuitry within the clock 11 from a battery for the duration of the AC power interruption.

U.S. Pat. No. 3,897,700 to Haydon discloses an apparatus for facilitating setting of a clock one hour ahead at the beginning of daylight saving time and back by one hour at the conclusion thereof. The time adjustments are initiated by maintenance personnel at each change of season.

U.S. Pat. No. 4,695,168 to Meister et al. discloses a clock which retains the correct date during power outages, even during replacements of a backup battery. Meister et al.'s clock has two motors and means for perpetually indicating the correct date which includes a date counter 31, a month counter 32 and a year counter 33. The counters provide signals to a correction circuit 34 so that the calendar automatically compensates for the length of each month and leap years. A nonvolatile memory 41 retains the contents of day, month and year counters during occasional power failures to assure restoration of the correct date when the power returns.

Other patents relating to the subject matter of the present invention include U.S. Pat. Nos. 4,447,160; 4,419,017; 4,271,494; 3,918,250; and 3,897,700.

SUMMARY OF THE INVENTION

Accordingly, it is a primary object of the present invention to provide a stand-alone, master-less clock for use in schools, factories, commercial buildings and the like.

It is a further object of the present invention to provide a multi-year clock which automatically adjusts itself for daylight saving time.

It is still a further object of the present invention to provide a multi-year clock which maintains accurate time over a period of at least twenty years.

It is yet another object of the present invention to provide a multi-year clock which is normally operable from an AC line source but which contains a battery backup which protects the clock against occasional AC power interruptions.

It is still a further object of the present invention to provide a multi-year clock which is normally AC driven and which is capable of operating for over a twenty year period with a single or pair of batteries, not larger than standard C size batteries.

It is yet a further object of the invention to provide a multi-year clock which automatically reduces its electrical power consumption during AC power interruptions.

It is still a further object of the present invention to provide a multi-year clock which generally consumes less power.

It is yet another object of the invention to provide a multi-year clock which automatically adjusts itself for daylight saving time and which, in addition, is capable of announcing or otherwise indicating yearly events such as birthdays, anniversaries, etc.

It is also an object of the present invention to provide a stand-alone multi-year clock which is factory programmed to adjust itself for daylight saving time and which is simplified by the deliberate omission therefrom of any user-operable means relating to user-initiated daylight saving time adjusting.

The foregoing and other objects of the invention are realized by means of a clock circuit suitable for driving a clock movement and including: a frequency generator for providing a timing reference; time keeping means coupled to the timing reference for developing time information; a memory containing event-hour information and event-identity information, said event-hour information being effective to indicate the time when predetermined events are to occur including daylight saving time schedules for a plurality of years; comparing means for comparing said time information developed by said time keeping means against said event-hour information obtained from said memory and activating a comparator output when said time information and event-hour information are matched; and a controller, responsive to said comparator output and to said event-identity information of said memory, for producing clock driving signals for driving a clock movement and for automatically adjusting the clock movement for daylight saving time over a plurality of years.

In accordance with preferred embodiments, the frequency generator includes an AC frequency source for developing a primary, AC derived, frequency signal and a secondary, crystal-oscillator-derived, frequency signal. It also includes clock operating means for normally operating the time keeping means from the primary frequency signal and for operating the same from the secondary frequency signal during AC power outages.

Furthermore, the time keeping means of the present invention provides a 1 Hz signal and a 2 Hz signal and the controller thereof is effective for selecting one or the other or neither of the 1 Hz signal and the 2 Hz signal for being applied to the clock movement. Further, the time keeping means comprises a second-to-hour converter for generating a one pulse per hour signal and an hour counter for producing a yearly-based hour count. A multi-year event counter is coupled to the memory and serves to step the memory from one event to the other over a plurality of years to thus sequentially apply data relating to successive events to the comparing means.

The clock circuit of the present invention is self contained and is free of cumbersome and expensive, user adjustable mechanisms for adjusting the clock circuit for daylight saving time by a user.

The clock circuit of the present invention is also supplied, in accordance with a preferred embodiment, with means for driving auxiliary devices such as a chime, a tape recorder, an indicator or the like.

Other features and advantages of the present invention will become apparent from the following description of the invention which refers to the accompanying drawings.

DETAILED DESCRIPTION OF THE DRAWINGS

Figure 1:
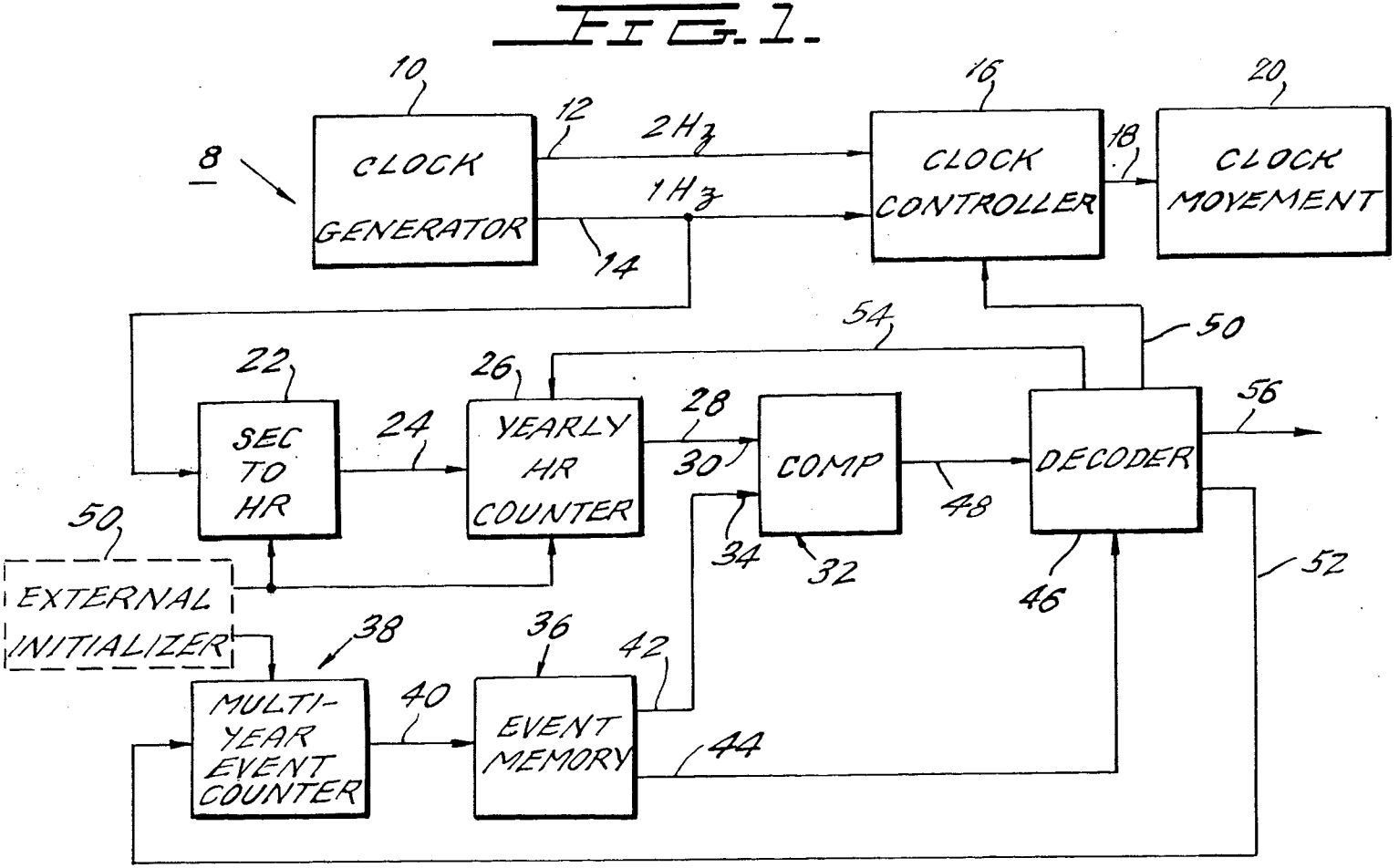
FIG. 1 is a simplified block diagram of the invention.

FIG. 1 is a simplified block diagram of a clock circuit 8 which includes a clock generator 10 for producing, from either the AC line voltage or from a crystal source, a 2 Hz (cycles per second) output 12 and a 1 Hz output 14, both outputs 12 and 14 being supplied to a clock controller 16. The output 18 of the clock controller 16 drives a conventional clock movement 20. The output 18 represents a single line or even a pair of lines for driving, for example, a conventional and widely used bipolar clock movement 20.

In the present invention, the clock controller 16 responds to the outputs 12 and 14 and to a control output 50 (to be described) such that the output 18 toggles at a 1 Hz rate to provide 1 second time marks for normal driving of the clock movement 20 or at a 2 Hz rate for advancing the clock movement 20 by one hour (over a one hour period), or no pulses for a period of one hour to set the clock movement 20 back by one hour.

The 1 Hz output 14 is further supplied to a second-to-hour converter 22—essentially a divide by 600 counter—which converts the 1 second input to a one pulse/-hour output 24. The one pulse/hour output 24 will be referred to as the hourly output 24. The hourly output 24 is supplied to a yearly hour counter 6 which serve to develop a yearly hour count, represented by the yearly hour count 28. The output 28 begins with a count of one (binary zero) at the start of each year and ends with a count of about 8760 hours at the end of a typical year. This yearly hour count output 28, consisting of at least 14 bits to enable counting to at least 8784 hours, is supplied to a first input 30 of a comparator 32.

A second input 34 of the comparator 32 receives another set of 14 bits of information from an event memory 36 which is supplied with address information, in the form of an address 40, from a multi-year event counter 38. Each successive memory location of the event memory 36 supplies data to first and second outputs of the event memory 36 including, respectively, an event-hour output 42 which is delivered to the comparator 32 and an event-identifier output 44. The event-hour output 42 always indicates, in yearly hours, the next time when an "event" is to occur. An "event" comprises, for example, the start or end of daylight saving time, the end of the year, an anniversary, an important yearly date, etc.

While the event-hour output 42 designates the yearly hour at which an event is to occur, the event-identifier output 44 identifies the nature of the particular event. The event-identifier output 44 therefore consists of two or more bits which are supplied to the decoder 46, informing the decoder 46 whether the particular event requires advancing or retarding the clock movement 20, or resetting the yearly hour counter 26 or activating a chime to announce an anniversary date, etc. The decoder 46 also responds to an hour-match output 48 from the comparator 32 which output 48 is active whenever the hour information at the inputs 30 and 34 of the comparator 32 are matched.

In response to the activation of the output 48 of comparator 32 and the event-identifier output 44 from memory 36, the decoder 46 activates or sets the bit pattern of any one or a combination of its own outputs. These outputs of the decoder 46 include a first, multi-bit, output 50 which serves to control the clock controller 16, a second output 52 which is activated on each event and which serves to advance the multi-year event counter 38 to cause the outputting from the event memory 36 information defining the next event, a third output 54 which resets the yearly hour counter 26 at the end of each year and, optionally, auxiliary outputs 56 which drive auxiliary devices (not shown) such as chimes, displays or the like.

The operation of the circuit of FIG. 1 is believed to be obvious from the foregoing description, but if it is not, the following example will help to clarify it and will add additional details as well. Assume that the event memory 36 is a typical ROM or RAM memory having sixty-four memory locations and sixteen bits of data at each memory location. Fourteen bits of the data will be therefore allocated to the event hour output 42 and two bits to the event-identifier output 44. With two bits, four events can be identified per year. Typical data stored in the event memory 36 may be as shown in Table 1 below in which three events are allocated per year. Note that by the simple expedient of adding one more bit to the event-identifier output 44, the number of identifiable yearly events can be as high as 8 and that four bits could identify 16 events, etc.

TABLE 1

| Memory Address | Hour Data | Event Data | Remarks |
|---|---|---|---|
| 1 | 2306 | 01 | Advance clock, during 1991 |
| 2 | 7202 | 10 | Set back clock, during 1991 |
| 3 | 8760 | 11 | End of year, 1991 |
| 4 | 2282 | 01 | Advance clock, during 1992 |
| 5 | 7322 | 10 | Set back clock, during 1992 |
| 6 | 8784 | 11 | End of year, 1992 |
| 7 | 2234 | 01 | Advance clock, during 1993 |
| 8 | 7274 | 10 | Set back clock, during 1993 |
| 9 | 8760 | 11 | End of year, 1993 |
| 10 | 2210 | 01 | Advance clock, during 1994 |
| 11 | 7250 | 10 | Set back clock, during 1994 |
| 12 | 8760 | 11 | End of year, 1994 |
| . | | | |
| . | | | |
| . | | | |
| 61 | 2210 | 01 | Advance clock, during 2011 |
| 62 | 7250 | 10 | Set back clock, during 2011 |
| 63 | 8760 | 11 | End of year, 2011 |
| 64 | | | |

In accordance with the above example, the clock of the present invention is programmed to run from the year 1991 to the end of 2011, uninterruptedly and without any user initiated actuation or inputs. The multi-year event counter 38 counts the events over the entire multi-decade period and ensures that the data supplied from the event memory 36 always defines, i.e. points to, the next event. From production and servicing viewpoints, it is desirable to produce clocks whose event memory 36 contents are identical. Let it be assumed, therefore, that all clocks contain information as in Table 1, meaning that these clocks are designed to run from 1991 to 2011. Such clocks, if a unit thereof were to be produced or serviced in 1993, would have been initialized at the factory by means of an external initializer jig 58 which is depicted in FIG. 1, in dotted lines. For example, in 1993 the multi-year event counter 38 would have been set to a count of 3 (represented by the binary value 000010) and the second-to-hour converter 22 and the yearly hour counter 26 would also be initialized as of the time when the clock was being set.

However, for the purposes of the present explanation, let it now be assumed that the clock is initialized during the first hour on Jan. 1st, 1991. This means that the output 40 of the event counter 38 is then equal to one (binary "000000"), the yearly hour count output 28 is set to zero hours, the event-hour output 42 indicates 2306 (the first hour data), and the event code output 44 produces the binary value 01.

Nothing will then occur for a period of 2306 hours, that is until 2 AM on that day in Apr., 1991 when the clock is to be advanced for daylight saving time. Eventually, however, the yearly hour counter 26 will accumulate 2306 hours, matching the similar number being outputted from the output 42 of the event memory 36. This will then cause the decoder 46 to respond to the code 01 from the output 44 of the event memory 36. The response will consist of the activation of the output 50 of the decoder 46 in a manner which will cause the clock controller 16 to select and apply to the clock movement 20 the 2 Hz output 12 for a period of one hour. The clock movement 20 will then move at twice its ordinary pace and will thus adjust itself for daylight saving time over the course of an hour. In addition, the decoder 46 will also output a pulse over its output 52 to cause the multi-year event counter 38 to advance to a count of "2", whereby the values 7202 and 10 will appear at the outputs 42 and 44 of the event memory 36, respectively.

Nothing will again occur for several months, that is until the yearly hour count output 28 will have reached a count of 7202, at which point the output 48 of comparator 32 will become activated again. At this point, however, the event data code from the output 44 will be equal to 10 and the decoder 46 will respond such that its output 50 will cause no clock pulses to be sent to the clock movement 20 for a period of one hour. This will effectively set the clock movement 20 back by one hour. And as before, the decoder 46 will also activate its output 52 to advance the event counter 38 by one in order to extract from the event memory 36 the information for the next event, i.e. the value 8760 which designates the end of the year 1991.

The above described process will repeat itself again and again over at least two decades. Thus, in accordance with the present invention, the owner of the clock is freed entirely from the burdens associated with adjusting the clock for daylight saving time. Indeed, the clock circuit of the present invention is far simpler than anything comparable in the prior art inasmuch as it does not even provide any hardware or means for the clock user to set or adjust the clock circuitry for the needed seasonal adjustments.

As will be described shortly and in greater detail by reference to FIG. 2, the clock circuit 8 of the present invention is normally powered from the AC line voltage but is backed up by battery power so as to enable the clock circuit 8 to run uninterruptedly for at least two decades while maintaining a prescribed accuracy range, without being affected by occasional line voltage outages. It should also be noted that while the event memory 36 has been described above to contain sixty-four memory locations and sixteen bits of data at each location, the size of the memory 36 can be easily increased to accommodate a greater number of years and/or a greater number of events per year. For , example, by increasing the number of bits of the event-identifier output 44 to three bits and using a 1K (1024) by 17 bit memory, the clock circuit 8 of the present invention could be preprogrammed with all the data necessary to run the clock for about 115 years while taking care of 8 different events per year.

Figure 2:
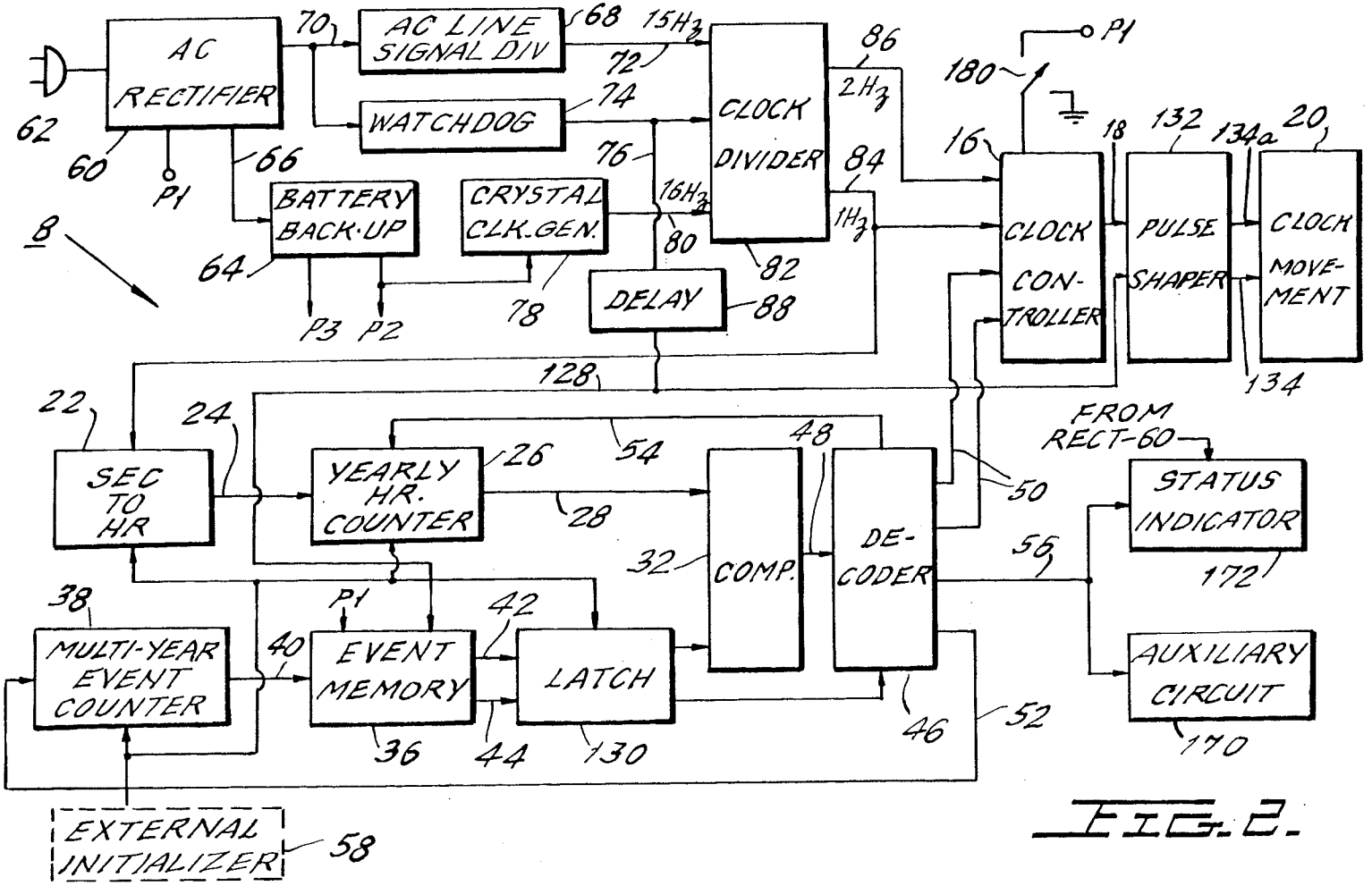
FIG. 2 is a more detailed block diagram of the present invention.
Figure 3:
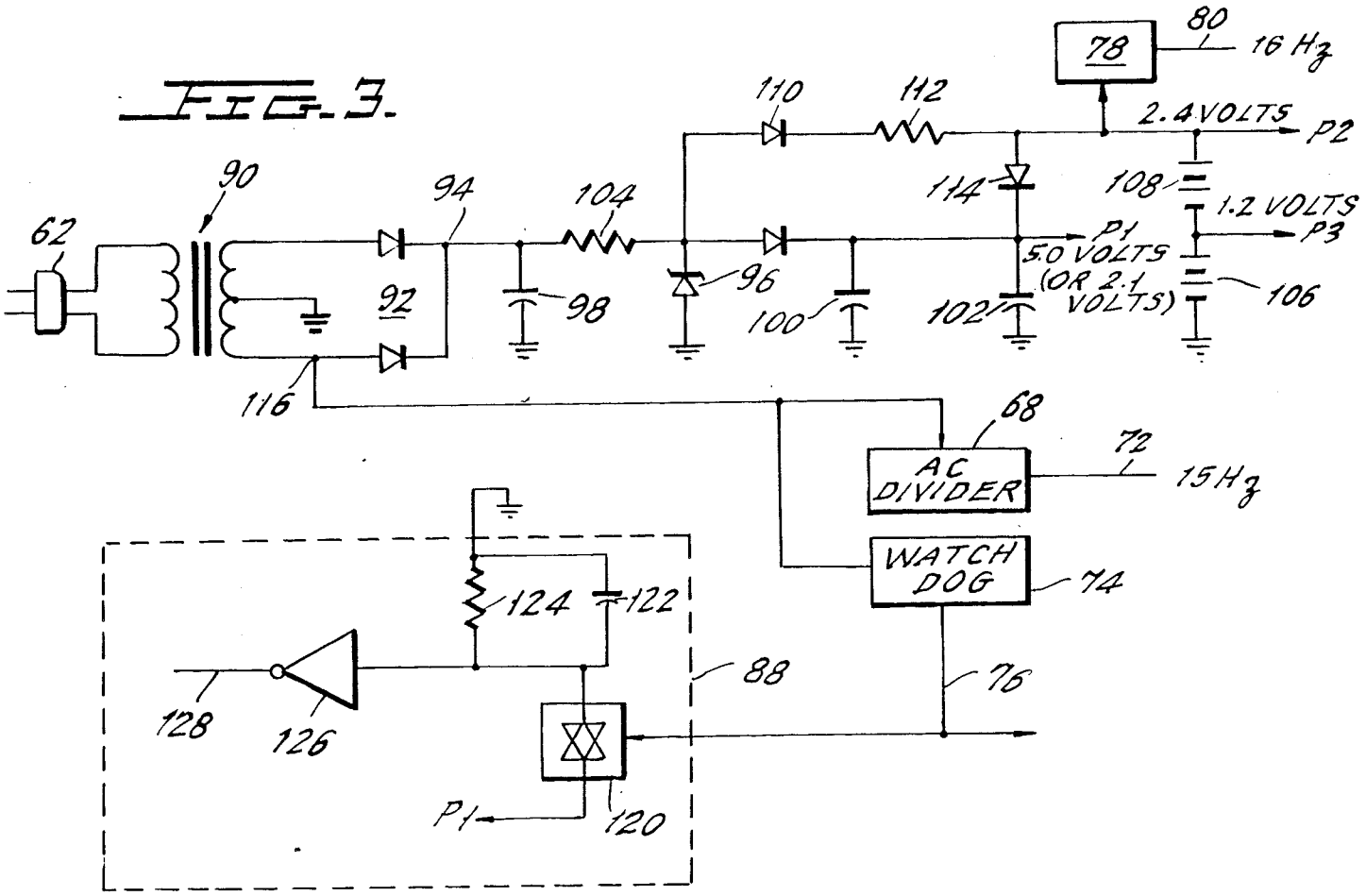
FIG. 3 is a schematic of a power supply circuit and a circuit for effecting smooth switching over from AC power to battery backup power during AC power interruptions.
Figure 4:
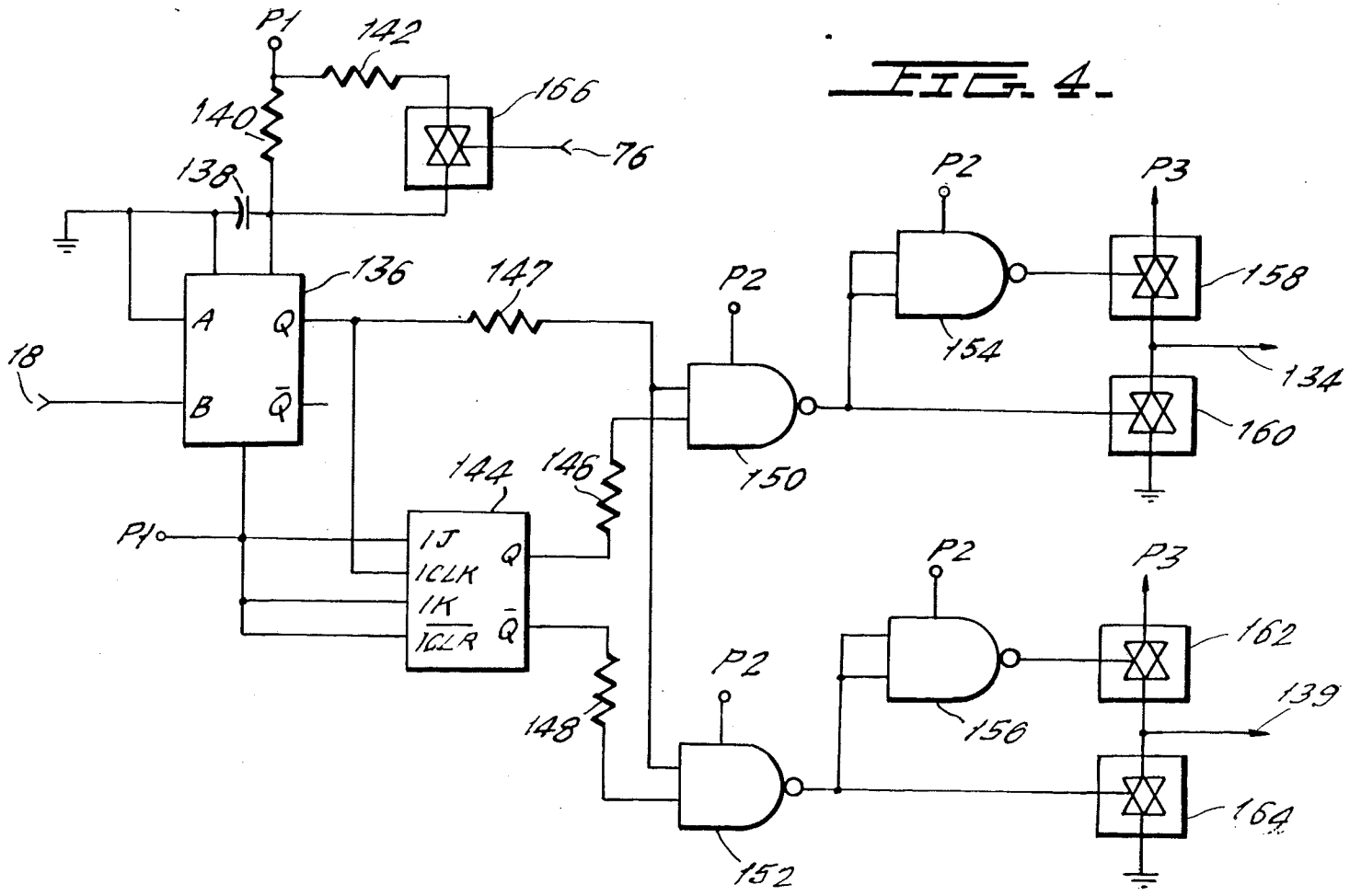
FIG. 4 is a schematic of a circuit for driving a bipolar clock movement.

For a more detailed description of the present invention, reference is now made to FIGS. 2–4. In FIG. 2, an AC power rectifier 60 receives a line voltage from a plug 62 and produces a first DC voltage output Pl of about 5.0 volts for driving logic circuitry such as the event memory 36. A battery backup 64 contains a pair of batteries for providing a second DC output P2 for powering a crystal clock generator 78 and a third DC output P3 for powering a conventional clock movement 20 which is driven with the clock circuit 8 of the present invention. The battery backup 64 may contain two "C" size Nickel Cadmium batteries which are rechargeable by power provided from the line 66 of the AC rectifier 60.

An AC line signal divider 68 receives an AC line output 70 from a secondary tap (not shown) of the rectifier 60 and produces therefrom a 15 Hz clock output 72. The AC watchdog circuit 74 monitors the output 70 and produces an AC status output 76 which assumes a predefined logic state to indicate an interruption of the AC input power.

The crystal clock generator 78 produces a 16 Hz output 80. A clock divider and selector circuit 82 produces both a 1 Hz output 84 and a 2 Hz output 86 by dividing either the 15 Hz output 72 or the 16 Hz output 80, based on the state of the AC status output 76. The AC status output 76 is also applied to other circuits of the present invention through a delaying circuit 88. The delaying circuit 88 ensures smooth changing over from the normally used 15 Hz output 72 which is produced from the line voltage to the crystal generated 16 Hz output 80.

The above-described portion cf FIG. 2 is illustrated in greater detail in FIG. 3 which shows the circuit to consist of the power plug 62, a transformer 90, and a half wave bridge rectifier 92 for producing at a node 94 a voltage of approximately 7 volts. A regulator and filter circuit, consisting of a zener diode 96, capacitors 98, 100 and 102 and resistor 104, delivers a voltage of 5.0 vdc at 25 milliamps at the power output Pl.

A pair of C sized Nickel Cadmium batteries 106 and 108 deliver a power output P3 in the form of 1.2 vdc at 0.5 milliamps for powering the clock movement 20, and a power output P2 which supplies 2.4 vdc at 1.5 milliamps. The diode 110 and resistor 112 provide a trickle charge of 3.0 vdc at 13 milliamps for charging the batteries 106 and 108. A germanium diode 114 assures that the voltage at Pl remains at about 2.1 volts when the power delivered through the transformer 90 is interrupted.

The AC oscillator and dividing circuit 78 powered from the output P2 contains a crystal oscillator which oscillates at a frequency of 4.194304 megahertz, resulting in the maintenance of a high degree of accuracy and minimal current drain. It is estimated that the accuracy of the clock circuit 8 of the present invention will be maintained to better than plus or minus 10 seconds per year when the output of the oscillator is not used for more than 240 hours per year and the AC power is cycled on/off less than ten times per year.

A tap 116 of the secondary of the transformer 90 is supplied to the AC line signal divider 68 and to the AC watchdog circuit 74. The watchdog circuit 74 may consist of a "one shot" type circuit which responds to the absence of voltage transitions at the secondary tap 116 for a predetermined time period by activating its AC status output 76.

The delaying circuit 88 consists of a bilateral analog switch 120 which is controlled by the AC status output 76, a capacitor 122, a resistor 124 and an inverter 126. Normally the switch 120 is open so that the input of the inverter 126 is connected to ground through resistor 124 to produce a "high" at the output 128 of the inverter 126 to indicate that AC power is on. However, when the AC power is interrupted the switch 120 closes and the input into the inverter 126 rapidly changes from zero to one with the charging of capacitor 122. This allows output 128 to activate all battery power switch-over circuits before power supply capacitors discharge. When AC power returns switch 120 is open so that the input of the inverter is connected to ground through resistor 124 and slowly discharges capacitor 122. Eventually the output 128 will change to a high logic state allowing, in the interim, an ongoing operation which may be taking place to be completed smoothly during any power switch-over.

Referring back to FIG. 2, the 2 Hz and 1 Hz outputs 86 and 84 are supplied to the clock controller 16, the 1 Hz output 84 also being supplied to the second-to-hour converter 22. In FIG. 2, the circuits including the second-to-hour converter 22, the yearly hour counter 26, the comparator 32, the multi-year event counter 38, and the event memory 36 represent the same components and operate in the same manner as have been described previously by reference to FIG. 1.

FIG. 2 further depicts a transparent latch 130 which is interposed between the event memory 36 and the comparator 32. During a power failure, the output 128 of the inverter 126 (FIG. 3) is supplied to the memory 36 and to the latch 130. This output 128 disables the memory 36 (to reduce power consumption) and "freezes" the contents thereof just before the power outage in the latch 130. This permits the operation of the clock circuit 8 of the present invention to proceed smoothly during the AC power interruption while the circuit 8 is driven from battery backup power and consumes less power. The transparent latch 130 may comprise a '573 type digital device.

The present invention has been reduced to practice in an embodiment designed for driving a conventional bipolar clock movement 20. For driving such a clock movement, the invention provides a special pulse shaper 132 which responds to the output 18 of the clock controller 16 by producing a pair of bipolar outputs 134 for driving the conventional bipolar clock movement 20. The pulse shaper 132 is illustrated in FIG. 4 and is there shown to consist of a "one shot" device 136 which responds to the output 18 of the clock controller 16 and produces at the "Q" output thereof pulses which last for a specific duration which is controlled by an RC network including the capacitor 138 and the resistors 140 and 142.

A JK flip flop 144 has outputs Q and $\overline{Q}$ which change states on alternate pulses from the output 18 and which drive gates 150 and 152 through current limiting resistors 146 and 148, respectively. The gates 150 and 152 also receive the shaped pulse which is provided from the "Q" output of the "one shot" 136, through a limiting resistor 147. An inverter 154 coupled to the output of the gate 150 and another inverter 156 which is coupled to the gate 152 cooperate with the gates 150 and 152 to drive bilateral analog switches 158, 160, 162 and 164 in a manner whereby the outputs 134 of the aforementioned switches are alternately connected to ground or to the DC output P3, on a mutually exclusive basis and such as to satisfy the stringent peculiarities of clock signals which are used for driving bipolar clock movements.

In this connection, it is known that bipolar clock movements are extremely sensitive to variations in voltage magnitude and pulse durations. Such variations can occur during AC power interruptions. Accordingly, the present invention compensates for such variations by changing the pulse width of the pulses supplied to the bipolar clock movement 20 during the battery backup mode. This is done with the switch 166 which is activated by the AC power status output 76 in a manner whereby the resistance 142 is either disconnected or connected in parallel with the resistor 140 to vary the RC time constant to obtain pulses of different width from the "Q" output of the "one shot" circuit 136. In other words, when the AC power is interrupted and the magnitude of the voltage Pl drops from about 5 volts to 2.1 volts, the effective resistance is altered such that the pulse width obtained from the "one shot" 136 is changed in a manner which ensures reliable driving of the bipolar clock movement 20.

The switch 180 (FIG. 2) which is coupled to the clock controller 16 enables selective turning on and off of the clock movement 20, without disturbing the time keeping function of the clock circuit 8 of the present invention. Also, while the foregoing has described the invention in relation to a bipolar clock movement, the circuit 8 is easily adaptable to all manners and types of clock movements.

Referring back to FIG. 2, it will be seen that the event decoder 46 also drives an auxiliary circuit 170 which comprises or drives a chime, a speech synthesizer, a bell, a tape recorder, or the like for responding to additional events such as anniversaries, important dates or the like.

The status indicator 172 contains LEDs and the like and is responsive to an input from the rectifier circuit 60 as well as to inputs from the event decoder 146 to produce visually perceivable indications of such occurrences as AC power failure or the like.

The external initializer 58 is not a component of the clock circuit 8. It is a factory based device which is used to reset or preset the multi-year event counter 26 as well as the second-tohour converter 22. This same device 58 may also be coupled to the event memory 36 for loading the event memory 36, assuming the same is constructed of RAM ICs, with data such as that which is shown in the aforementioned Table 1. The external initializer 58 may also be used to load user-specified contents in the memory 36.

Accordingly, the present invention achieves its key objectives in that it frees the owner of the clock circuit 8 of the present invention from the burdens normally associated with adjusting clocks for standard daylight saving time. It is a considerably simplified clock circuit because it provides sufficient memory which enables running of a clock for many decades or even for over a century. It is also a very simple and compact circuit because it deliberately leaves out complicated user controlled clock adjusting circuitry. The clock circuit 8 of the present invention has been found to reduce the power consumption of ordinary motor synchronized clocks to less than 2 watts. Its bilateral analog switches enable the clock circuit of the present invention to easily switch from a primary AC derived, time standard to a secondary (crystal) time standard. The circuit also conserves power during AC power outages.

Furthermore, the clock circuit 8 of the present invention can be easily reconfigured. For example the event memory 36 may be comprised of a preprogrammed ROM IC which is mounted on a socket for easy replacement thereof. Alternatively, the event memory 36 can consist of a RAM which is programmed at the factory by means of the external initializer 58.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A clock circuit for driving a clock movement, the clock circuit comprising:

a frequency generator for providing a timing reference;

time keeping means coupled to the timing reference for developing time information;

a memory containing event-hour information and event-identifying information, said event-hour information being effective to indicate the time when predetermined events are to occur including daylight saving time schedules for a plurality of years;

comparing means for comparing said time information developed by said time keeping means against said event-hour information obtained from said memory and activating a comparator output when said time information and event-hour information are matched;

a controller, responsive to said comparator output and to said event-identifying information of said memory, for producing clock driving signals for driving a clock movement and for automatically adjusting the clock movement for daylight saving time over a plurality of years;

wherein said frequency generator includes an AC frequency source for developing a primary, AC derived, frequency signal and a secondary, crystal-oscillator-derived, frequency signal and including clock operating means for normally operating said time keeping means from said primary frequency signal and from said secondary frequency signal during AC power outages;

said clock operating means comprising AC power detecting means for detecting said AC power outages and means for producing an AC power status output; and further comprising a latch coupled between said memory and said controller, delaying means for providing a delayed version of said AC power status output to said memory and to said latch in a manner such that, during power outages, information supplied from said memory is latched in said latch for use during said power outages.

2. A clock circuit for driving a clock movement, the clock circuit comprising:

a frequency generator for providing a timing reference;

time keeping means coupled to the timing reference for developing time information;

a memory containing event-hour information and event-identifying information, said event-hour information being effective to indicate the time when predetermined events are to occur including daylight saving time schedules for a plurality of years;

comparing means for comparing said time information developed by said time keeping means against said event-hour information obtained from said memory and activating a comparator output when said time information and event-hour information are matched;

a controller, responsive to said comparator output and to said event-identifying information of said memory, for producing clock driving signals for driving a clock movement and for automatically adjusting the clock movement for daylight saving time over a plurality of years; and further comprising pulse width adjusting means for adjusting the pulse width of clock movement driving pulses which are applied to a clock movement.

3. The clock circuit of claim 2, wherein said frequency generator includes an AC frequency source for developing a primary, AC derived, frequency signal and a secondary, crystal-oscillator-derived, frequency signal and including clock operating means for normally operating said time keeping means from said primary frequency signal and from said secondary frequency signal during AC power outages.

4. The clock circuit of claim 3, wherein said clock operating means comprises AC power detecting means for detecting said AC power outages and means for producing an AC power status output.

5. The clock circuit of claim 4, further comprising a latch coupled between said memory and said controller, delaying means for providing a delayed version of said AC power status output to said memory and to said latch in a manner such that, during power outages, information supplied from said memory is latched in said latch for use during said power outages.

6. The clock circuit of claim 2, wherein said time keeping means comprises an hour counter and said controller comprises a decoder and said decoder provides a plurality of outputs including a first output for resetting the hour counter at the end of each year.

7. The clock circuit of claim 6, wherein the decoder provides a second output for controlling a clock movement to carry out daylight saving time adjustments.

8. The clock circuit of claim 7, wherein said time keeping means comprises a multi-year event counter for providing address information to the memory and wherein the decoder includes a third output for incrementing the address information provided by the multi-year event counter, after each event.

9. A clock circuit for driving a clock movement, the clock circuit comprising:

a frequency generator for providing a timing reference;

time keeping means coupled to the timing reference for developing time information;

a memory containing event-hour information and event-identifying information, said event-hour information being effective to indicate the time when predetermined events are to occur including daylight saving time schedules for a plurality of years;

comparing means for comparing said time information developed by said time keeping means against said event-hour information obtained from said memory and activating a comparator output when said time information and event-hour information are matched; and a controller, responsive to said comparator output and to said event-identifying information of said memory, for producing clock driving signals for driving a clock movement and for automatically adjusting the clock movement for daylight saving time over a plurality of years;

wherein said time keeping means provides a normal clock signal and a fast clock signal and wherein said controller is effective for selecting one or the other or neither of said normal clock signal and said fast clock signal for being applied for driving a clock movement.

10. A clock circuit for driving a clock movement, the clock circuit comprising:

a frequency generator for providing a timing reference;

time keeping means coupled to the timing reference for developing time information;

a memory containing event-hour information and event-identifying information, said event-hour information being effective to indicate the time when predetermined events are to occur including daylight saving time schedules for a plurality of years;

comparing means for comparing said time information developed by said time keeping means against said event-hour information obtained from said memory and activating a comparator output when said time information and event-hour information are matched; and a controller, responsive to said comparator output and to said event-identifying information of said memory, for producing clock driving signals for driving a clock movement and for automatically adjusting the clock movement for daylight saving time over a plurality of years;

wherein said time keeping means provides a 1 Hz signal and a 2 Hz signal and wherein said controller is effective for selecting one or the other or neither of said 1 Hz signal and said 2 Hz signal for being applied for driving a clock movement.

11. The clock circiut of claim 10, wherein said time keeping means comprises a second-to-hour converter for generating a one pulse per hour signal.

12. The clock circuit of claim 11, wherein said time keeping means comprises an hour counter for producing an hour count.

13. The clock circuit of claim 12, wherein the hour counter is effective for producing a yearly hour count.

14. The clock circuit of claim 13, wherein said controller comprises a multi-year event counter coupled to the memory for providing to the memory an address of a next event over a period of a plurality of years.

15. A clock circuit for driving a clock movement, the clock circuit comprising:

a frequency generator for providing a timing reference;

time keeping means coupled to the timing reference for developing time information;

a memory containing event-hour information and event-identifying information, said event-hour information being effective to indicate the time when predetermined events are to occur including daylight saving time schedules for a plurality of years;

comparing means for comparing said time information developed by said time keeping means against said event-hour information obtained from said memory and activating a comparator output when said time information and event-hour information are matched; and a controller, responsive to said comparator output and to said event-identifying information of said memory, for producing clock driving signals for driving clock movement and for automatically adjusting the clock movement for daylight saving time over a plurality of years;

said time keeping means comprising an hour counter and said controller comprising a decoder and said decoder providing a plurality of outputs including a first output for resetting the hour counter at the end of each year;

the decoder providing a second output for controlling a clock movement to carry out daylight saving time adjustments;

said time keeping means further comprising a multi-year event counter for providing address information to the memory and the decoder including a third output for incrementing the address information provided by the multi-year event counter, after each event;

the decoder further including a fourth output for driving auxiliary devices.

16. The clock circuit of claim 15, wherein the auxiliary devices include a chime.

17. A clock circuit for driving a clock movement, the clock circuit comprising:

a frequency generator for providing a timing reference;

time keeping means coupled to the timing reference for developing time information;

a memory containing event-hour information and event-identifying information, said event-hour information being effective to indicate the time when predetermined events are to occur including daylight saving time schedules for a plurality of years;

comparing means from comparing said time information developed by said time keeping means against said event-hour information obtained from said memory and activating a comparator output when said time information and event-hour information are matched;

a controller, responsive to said comparator output and to said event-identifying information of said memory, for producing clock driving signals for driving a clock movement and for automatically adjusting the clock movement for daylight saving time over a plurality of years; and the clock circuit being self-contained and free of user adjustable mechanism relating to adjusting of a clock movement for daylight savings time.

18. The clock circuit of claim 17, wherein said frequency generator includes an AC frequency source for developing a primary, AC derived, frequency signal and a secondary, crystal-oscillator-derived, frequency signal and including clock operating means for normally operating said time keeping means from said primary frequency signal and from said secondary frequency signal during AC power outages.

19. The clock circuit of claim 17, wherein said time keeping means comprises an hour counter and said controller comprises a decoder and said decoder provides a plurality of outputs including a first output for resetting the hour counter at the end of each year.

20. The clock circuit of claim 19, wherein the decoder provides a second output for controlling a clock movement to carry out daylight saving time adjustments.

* * * * *